United States Patent [19]

Muzio

[11] 4,355,317

[45] Oct. 19, 1982

[54] DISH ANTENNA AND METHOD FOR MAKING

[75] Inventor: Andrew R. Muzio, Newnan, Ga.

[73] Assignee: Georgia Tech Research Institute, Atlanta, Ga.

[21] Appl. No.: 209,327

[22] Filed: Nov. 24, 1980

[51] Int. Cl.[3] ..... H01Q 19/12

[52] U.S. Cl. ..... 343/840; 343/912

[58] Field of Search ..... 343/840, 915, 902, 872, 343/873, 912, 914

[56] References Cited

U.S. PATENT DOCUMENTS

| | | | |
|---|---|---|---|
| 2,072,262 | 3/1937 | Herzog et al. | 343/840 |
| 2,786,998 | 3/1957 | Davis | 343/915 |
| 2,945,233 | 7/1960 | Wild et al. | 343/840 |
| 3,397,399 | 4/1968 | Carman et al. | 343/915 |
| 3,599,218 | 8/1971 | Williamson | 343/872 |
| 4,001,836 | 1/1977 | Archer et al. | 343/756 |
| 4,274,099 | 6/1981 | Downs | 343/873 |

*Primary Examiner*—David K. Moore

*Attorney, Agent, or Firm*—Newton, Hopkins & Ormsby

[57] ABSTRACT

A lightweight inexpensive fiberglass antenna dish is disclosed, as well as a method for the manufacture thereof. The dish may be formed by spraying chopped fiberglass and epoxy binder onto the glazed surface of a parabolic mold. An aperture formed on the focal axis of the antenna dish, either at the time of molding or at a later time, accommodates a heavy wall structural tube which extends along the focal axis half-way towards the focal point and which is secured to the dish. Rods secured between the dish surface and the distal end of the tube form triangular shapes in cross-section which rigidify the dish element. The feed unit, such as a horn, is attached to the distal end of the tube and the transmission lines therefore can pass through the tube itself.

11 Claims, 2 Drawing Figures

DISH ANTENNA AND METHOD FOR MAKING

BACKGROUND OF THE INVENTION

1. Field of the Invention

The present invention relates to a lightweight dish antenna. More particularly, the present invention relates to a dish antenna which is light in weight and inexpensive to construct, as well as a process for the construction thereof.

2. BRIEF DESCRIPTION OF THE PRIOR ART

It has been known in the art to construct dish antennas of fiberglass or other thermosetting material. An example of this may be found in U.S. Pat. No. 2,945,233 to Wild et al. However, the construction of these antennas was relatively complex and accordingly the cost of manufacture of such antennas was quite high. This was because it was necessary to rigidify the antenna dish and the elements required for such rigidification tended to increase the number of parts associated with the antenna and the complexity of assembly, and accordingly increase the material and labor cost required for the construction thereof. For example, in the aforementioned U.S. Pat. No. 2,945,233, it was necessary to provide a support element 9 which was formed into a parabolic shape similar to that of the dish. The construction and mounting of the support increased the cost and complexity of the dish. This is particularly true in view of the fact that the dish disclosed in U.S. Pat. No. 2,945,233 also required a transmission line 6 extending between the dish surface and the radiator 1. Accordingly, there has been a need for a light weight dish antenna which can be quickly and cheaply built with a minimum number of parts.

SUMMARY OF THE INVENTION

It is an object of the present invention to provide a light weight antenna dish composed of a thermosetting plastic material.

It is a further object of the present invention to provide a dish antenna which can be inexpensively constructed.

It is a further object of the present invention to provide a dish antenna which can be constructed with a minimal number of parts.

It is a final object of the present invention to provide a method for manufacturing the dish antenna of the present invention.

In the present invention, the dish antenna includes a plastic dish element, which is preferably formed of fiberglass, and which defines a focal point located on a focal axis. The dish element includes an aperture at the focal axis and a heavy wall structural tube, which may be formed of aluminum, lightweight alloy, or dielectric material such as fiberglass is positioned within the aperture and extends along the focal axis to a point approximately halfway between the aperture and the focal point. The distal end of the tube should not extend beyond one-half of the distance between the focal point and the aperture since this could cause unnecessary blockage of the feed pattern to the dish surface. Further, the tube should not extend substantially less than one-half of the distance to the focal point since this could weaken the rigidifying structure of which the tube is a part, as described later in the present specification.

A plurality of small diameter rigid rods are secured between the distal end of the tube and the dish element, in a circumferential array. These rods, together with the tube and the antenna dish element, form triangles in cross-section, such triangular cross-sections being particularly rigid and able to withstand forces which could otherwise distort or crack the antenna dish surface.

An antenna feed unit such as a horn can be secured to the distal end of the tube and extends to the focal point of the antenna dish. The transmission line for the antenna feed unit extends through the tube and connects to the antenna feed unit at the tube. Accordingly, the tube has dual functions. First, it forms a rigid structural element which, together with the rods, comprises the rigidifying members for the antenna dish. Secondly, it forms a conduit for the transmission line of the antenna feeding unit. Therefore, by the use of a small number of elements attached to the antenna dish, the antenna dish can be rigidified and made to supply power to the feed unit. This reduces the complexity of manufacture, as well as the cost of the antenna dish.

As a further feature of the present invention, a method for the manufacturing of the dish is disclosed. The dish element itself can be molded from a chopped fiberglass and epoxy mixture which is sprayed upon the glazed surface of a mold. Once dried, the fiberglass dish can be removed from the mold and an aperture cut into the dish at the focal axis. Alternatively, the dish can be initially formed with the aperture by masking off a portion of the mold corresponding to the aperture. The tube can then be inserted through the aperture and fixed to the antenna dish element, for example by bolts, and the rods can be secured between the distal end of the tube and the dish to rigidify the antenna dish element. Finally, the transmission line can be passed through the center of the tube and connected to the horn which is fixed to the distal end of the tube. Accordingly, a simple method of manufacture is provided which utilizes a reduced number of parts for forming the reflecting dish antenna.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 2:
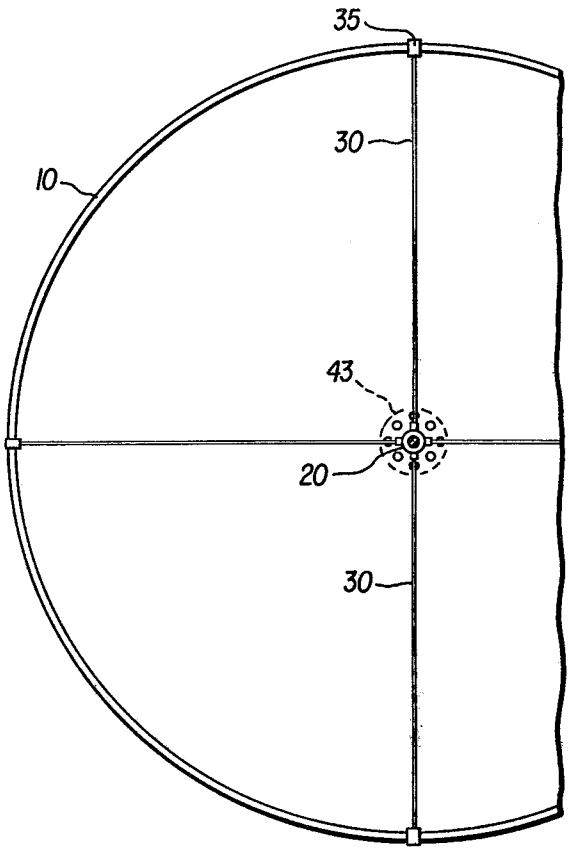
FIG. 2 is a view taken along line II—II of FIG. 1.

The preferred embodiment of the present invention will now be described in reference to the attached figures in which corresponding reference numerals refer to the same elements throughout the several views.

The dish antenna of the present invention is composed of four basic elements which can be quickly and easily assembled to form the structure of the invention. These four elements are the antenna dish element, the tube 20, the rods 30 and the antenna feeding assembly 40.

The dish element consists of a parabolic dish formed of fiberglass or any other lightweight plastic material. It is preferably fabricated by spraying a combination of chopped fiberglass and an epoxy binder onto the surface of a parabolic glazed mold. This technique is well known and is presently used in building small boats and bathroom fixtures. A reflective surface 11, such as a metallic reflective surface, may then be provided on one of the surfaces of the antenna dish element by spraying, condensation, or any other known manner of applying a thin layer of reflective material. Alternatively, a reflective layer, such as a parabolic screen, may be incorporated into the structure of the antenna dish during the fabrication thereof (U.S. Pat. No. 2,945,233, cited above, discusses the utilization of a screen as the reflective surface of a dish element).

The antenna dish element includes an aperture 12 at the location where the focal axis 33 meets the dish surface. This aperture accommodates the heavy wall structural tube 20, as will be discussed. The aperture can be formed in the antenna dish following the removal of the dish from the mold, as by cutting, or the aperture 12 may be formed integrally with the dish element at the time when the dish element is fabricated. This may be done, for example, by masking off the area corresponding to the aperture during the spraying of the fiberglass and epoxy onto the mold surface. The dish surface includes holes 14 for the rods 30, to be described, and these holes 14 can be formed in the same manner as the aperture 12.

The heavy wall structural tube 20 is inserted through the aperture 12 and extends along the focal axis 13 towards the focal point 41. The distal end 42 of the tube 20 should extend to approximately half-way between the aperture 12 and the focal point 41. If it extends further than approximately half-way to the focal point 41, unnecessary blockage of the feed pattern from the horn 40 may result. Conversely, if it extends substantially less than one-half of this distance, the strength provided by the rods 30 will be lessened.

The tube 20 is preferably contructed of a strong, relatively light weight structural material such as aluminum, light weight ferric alloy, or dielectric material such as fiberglass. It includes a flange 43 which may be welded thereto and which may in turn be fixed to the dish element, as by bolting, in order to firmly secure the structural tube to the dish element. Although the flange 43 provides securement between the dish and the tube, it does not contribute a substantial portion towards the rigidifying of the antenna dish since this function is performed by the small diameter rigid rods 30.

The rods 30, which are also formed of a strong structural material, such as aluminum, or ferric alloy, or dielectric material such as fiberglass are connected between the distal end 42 of the tube and the antenna dish. Preferably, the rods extend radially from the distal end of the tube in an evenly spaced circumferential pattern, as can be seen in FIG. 2, wherein the circumferential pattern consists of four sets of rods circumferentially separated by 90°. The rods can be secured to the distal end of the tube by any desired method, such as by bolting or by welding. The rods may be affixed to a flange 44 which is bolted or welded to the distal end of the tube. The rods may also be affixed to the dish element by any desired method, as by being fixed to a bracket 35 secured to the antenna dish, or by passing through the holes 14 in the antenna dish and being secured by nuts threaded to the ends of the rods 30 at both sides of the antenna dish element.

Figure 1:
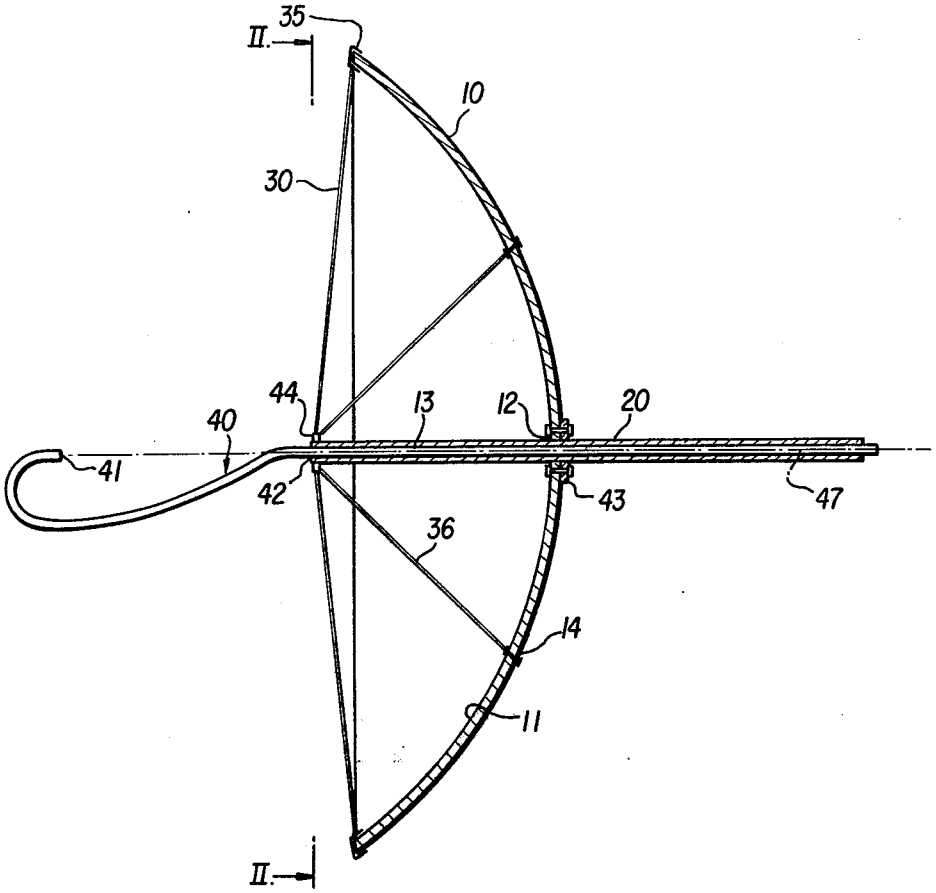
FIG. 1 is a cross-sectional view of the reflecting antenna of the present invention.

The rods preferably extend to the periphery of the dish element and additional rods 36 may be affixed to the antenna dish surface at a point which is radially approximately half-way between the focal axis and the periphery of the dish element. As can best be seen in FIG. 1, the rods 30 and 36, together with the tube 20 and the antenna dish element 10, form a plurality of triangles in section. It is well known that triangular shapes are the most rigid structural shapes known and these triangular sectional shapes result in a strong antenna dish which is able to withstand the deforming and cracking stresses which the dish might undergo during use. The location of the distal end at a point approximately half-way between the focal point and the aperture 12 results in relatively regular triangular sectional shapes.

The horn 40 extends from the distal end of the tube towards the focal point 41 and provides a feed for the antenna dish. The horn requires transmission lines, however these transmission lines can be passed through the hollow structural tube 20 and accordingly it is not necessary to provide separate means for accommodating the transmission lines of the horn.

Accordingly, an antenna dish is provided which is lightweight and simple to construct and which utilizes a minimal number of parts since the rigidifying tube 20 and the rods 30 can be quickly and easily assembled with the dish element. Further, the simplification of the structure is enhanced by the ability of the rigidifying structure in the form of the tube 20 to accommodate the transmission lines for the horn 40.

The dish could also be made in two, four, or more sections which could be bolted together. This would facilitate transporting the antenna assembly.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for the manufacture of a dish antenna, comprising:

preparing a mold having a parabolic glazed surface which defines a focal length along a focal axis;

depositing a uniform thickness layer of a plastic material on said glazed surface to form a dish element having an aperture on said focal axis;

removing said dish element from said mold;

fixedly positioning a heavy wall structural tube along said focal axis, said tube extending through said aperture and having a distal end extending towards said focal point;

providing a parabolic reflective coating on said dish element;

fixing small diameter rigid rods between said distal end of said tube and said dish element in such a manner that said tube, rods and dish element form substantially triangular cross-sections;

extending an antenna feed from said distal end of said tube to said focal point; and passing the transmission line for said antenna feed through said tube.

2. The method of claim 1, wherein said distal end of said tube is located approximately one-half of the distance between said dish element and said focal point.

3. The method of claim 2, wherein at least some of said rods are secured adjacent the peripheral edge of said dish.

4. The method of claim 1, wherein the fixing of said rods to said dish is by bolts.

5. The method of claim 1, wherein said plastic material is a composition comprising chopped fiberglass and epoxy binder.

6. A dish antenna comprising:

a parabolic dish element composed of plastic material and having a focal axis, a focal point on said focal axis and an aperture in said dish element at said focal axis;

a heavy wall structural tube fixed to said dish element and having a distal end extending along said focal axis through said aperture and towards said focal point;

a plurality of small diameter rigid rods fixed between said distal end and said dish element to form in cross-section, together with said dish element and said tube, a plurality of substantially triangular sections;

an antenna feed extending from said distal end of said tube to said focal point; and a transmission line for said antenna feed extending through said tube.

7. The antenna of claim 6, wherein said distal end of said tube is located approximately half way between said dish element and said focal point.

8. The antenna of claim 7, wherein at least some of said rods are secured adjacent the peripheral edge of said dish.

9. The antenna of claim 6, wherein each said rod includes a flange and said flange is secured to said dish element by bolts.

10. The antenna of claim 6, wherein said plastic material is a composition comprising chopped fiberglass and epoxy binder.

11. The antenna of claim 8, wherein at least some of the remaining rods are secured to said dish at points radially located approximately half way between said peripheral edge and said focal axis.

* * * * *